US005536318A

United States Patent [19]

Hashiuchi et al.

[11] Patent Number: 5,536,318

[45] Date of Patent: Jul. 16, 1996

[54] APPARATUS FOR COATING MOLDS WITH FINNING PREVENTIVE AGENT

[75] Inventors: Fumio Hashiuchi; Yushirou Hirai; Eiji Iwasaki, all of Oita-ken, Japan

[73] Assignee: Nippon Mining & Metals Co., Ltd., Tokyo, Japan

[21] Appl. No.: 319,508

[22] Filed: Oct. 6, 1994

[30] Foreign Application Priority Data

May 9, 1994 [JP] Japan ..... 6-119537
Jul. 29, 1994 [JP] Japan ..... 6-197721

[51] Int. Cl.[6] ..... B05C 1/00

[52] U.S. Cl. ..... 118/697; 118/214; 118/216; 118/254; 118/255; 164/267; 164/269; 164/326; 901/43

[58] Field of Search ..... 118/697, 214, 118/216, 254, 255; 427/133, 135, 230, 231, 239, 429; 901/41, 43; 15/21.1, 53.1–53.3, 88.1–88.4, 77, 97.1, 97.3, 102; 264/39, 338; 164/267, 269, 326

[56] References Cited

U.S. PATENT DOCUMENTS 3,691,582 9/1972 Call ..... 15/77
4,881,289 11/1989 Tsuyoshi et al. ..... 118/697
4,993,097 2/1991 D'Amato ..... 15/77
5,421,218 6/1995 Akeel et al. ..... 901/43

FOREIGN PATENT DOCUMENTS 0133513 2/1985 European Pat. Off. ..... 901/43
5309471 5/1993 Japan .
2166066 4/1986 United Kingdom ..... 901/43

*Primary Examiner*—Laura Edwards
*Attorney, Agent, or Firm*—Panitch Schwarze Jacobs & Nadel

[57] ABSTRACT

A method of application of finning preventive agent in an apparatus for casting anodes for electrolyzing copper by pouring molten copper into the molds, in which the inner planes of the molds can be coated with the finning preventive agent in a reliable and efficient manner, is provided. Before pouring molten copper into the molds, silicon oil is automatically applied to the inner planes $2a_1$, to $2a_{10}$ of the molds M dividedly in three applications by industrial robots 24, 25 of a vertical multi-articulate type having brushes 30. An amount of silicon oil consumed is 4 to 10 cc for one mold.

4 Claims, 6 Drawing Sheets

APPARATUS FOR COATING MOLDS WITH FINNING PREVENTIVE AGENT

FIELD OF THE INVENTION

The present invention relates to an art of casting anodes for electrolyzing copper by pouring molten copper into molds, and particularly to a method for coating with finning preventive agent for a purpose of preventing the formation of fins at edges of anodes for electrolyzing copper and an apparatus therefor.

BACKGROUND OF THE INVENTION

As a method of casting anodes for electrolyzing copper, the Walker System, in which molten copper is poured into horizontally positioned molds M, as shown in FIG. 5, has been widely used.

That is, conventional molds M for anodes were made by pouring, as an example, refined blister copper with the copper grade of about 99.3% coming out of a refining furnace, which constitutes the last stage in a melt-refining process, into the molds formed in a prescribed shape with cast steel, etc. Such a shape contains, in general, a base 1 having the same shape as that of an anode and edges 2 which surround the outer circumference of the base 1 and at the same time protrude upwards from the upper plane 1*a* of the base 1 by a prescribed height. That is, the mold M for casting anode had a recess S which is defined by the upper plane 1*a* of the base 1 and inner circumferential planes 2*a* of the edges 2 which protrude upwards out of the upper plane 1*a* of the base, and molten copper consisting of refined blister copper was poured into this recess S for forming such anode A for electrolyzing copper as shown in FIG. 6.

However, when a horizontal casting was done using a mold M according to the Walker System as mentioned above, as molten copper was poured into the mold, fins were formed at the upper edges "e" of outer circumferences of the anode A, which correspond to interfaces between the mold M and the molten metal. It was very difficult to prevent the formation of such fins.

Also, such fins on an anode caused troubles in an anode aligning machine such as obstructing an insertion of starting sheets (cathodes) in a refining process of copper electrolysis, or caused an anode to come in contact with other anodes, causing a short-circuiting at the time of the electrolysis, thus lowering the current efficiency.

In an effort to overcome such troubles, adjustments were made in a molten metal temperature, a speed of pouring molten metal and a height of cast metal, etc, but none of such adjustment trials provided truly effective finning preventive method. Also it was difficult to control the conditions in such adjustment methods to a uniform level. Thus, such approaches could not secure a satisfactory finning preventive technology.

Therefore, the present inventors provided, for a purpose of solving such problems as mentioned above, a casting method of anodes for electrolyzing copper as disclosed by the publication of the Patent Laid Open No.5(1993)-309471. In this casting method for anodes for electrolyzing copper, the generation of fins could be effectively prevented by coating inner circumferential planes of a mold with finning preventive agent, which had a flash point of 190° C.~230° and a kinematic viscosity of more than 50 cSt, by a ratio of 50 ml/m$^2$ 150 ml/m$^2$, before pouring the molten copper into the mold.

Also this casting method could be satisfactorily carried out with a casting apparatus for anodes for electrolyzing copper, which comprised, as shown in FIG. 7, a mold transfer means 60 for retaining a mold M in a horizontal posture and transferring it along a predetermined transfer path; and an application apparatus 50 for finning preventive agent being provided above the mold transfer means 60 across the transfer path of the mold, and in which the application apparatus 50 for finning preventive agent had a plurality of spray nozzles 51, finning preventive agent supply pipes 52 which supplied the finning preventive agent from a finning preventive agent supply source to each one of the spray nozzles 51; and control devices 53 which controlled the feeding and no-feeding of the finning preventive agent to each spray nozzle 51 were provided.

In this casting apparatus, the finning preventive agent from the spray nozzles 51 could be sprayed over inner circumferential planes $2a_1$~$2a_{10}$ of the mold, while the feeding and no-feeding of the agent were controlled by the control devices 53.

However, when the inner circumferential planes $2a_1$~$2a_{10}$ of the mold M were coated with finning preventive agent by such casting method for anode for electrolysis of copper as mentioned above, it was difficult to completely prevent the generation of fins due to a clogging of the spray nozzles and uneven coating with sprays. Also, as a great amount of the finning preventive agent had to be sprayed for completely coating the inner circumferential planes of the mold with the finning preventive agent, the method was not economical.

SUMMARY OF THE INVENTION

Under the circumstances, it is an object of this invention to provide a coating method and an apparatus, which can automatically coat inner circumferential planes of a mold with finning preventive agent in a reliable and efficient manner in an apparatus to pour molten copper into the mold to cast anodes for electrolyzing copper.

The above mentioned object is achieved by a finning preventive agent application method and apparatus according to the this invention. This invention may be summarized as a method of coating with finning preventive agent the inner planes of molds for casting copper anode which is placed on and carried by a circulatingly moving mold transfer means, being characterized in that industrial robots of a vertical multi-articulate type having application members are provided above the mold transfer means, then at least portions of the inner planes of the molds are coated with finning preventive agent by these robots at every circulation of the mold, as they are moved around by the mold transfer means.

It is preferable that entire inner planes of each mold are coated with divided coatings in one to a few coatings.

It is preferable that an amount of the finning preventive agent applied on the inner surfaces of one mold is 4 to 10 cc.

Also, in an another mode of the invention, an apparatus for applying finning preventive agent is provided, wherein molds for casting a copper anode are placed on and transferred by a mold transfer means which moves in a circulating manner and the inner planes of the molds are coated with finning preventive agent, characterized in that industrial robots of a vertical multi-articulate type are positioned above the mold transfer means and application members are attached to wrist portions of the industrial robots.

The industrial robots should preferably have 6 degrees of freedom of motion.

The application members are preferably brushes.

The finning preventive agent should be preferably fed to the application member by dipping the member in a silicone oil housing part.

The finning preventive agent should be preferably fed to the application member by a feeding pump.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF PREFERRED EMBODIMENT

Figure 1:
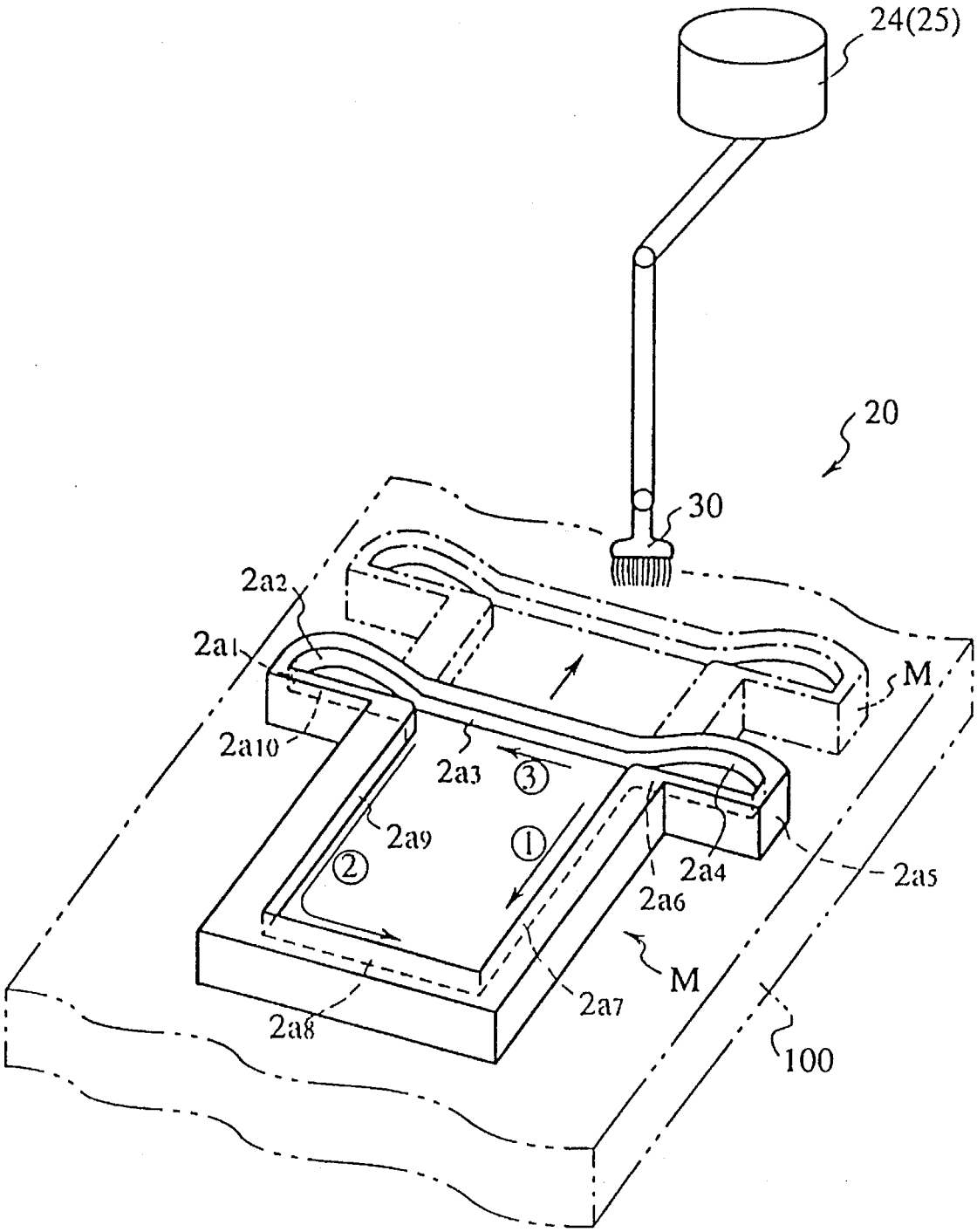
FIG. 1 is a schematic view for describing an application method and an apparatus for finning preventive agent according to this invention.

Now, the application method and apparatus of finning preventive agent according to this invention shall be explained by way of an example in further detail referring to the drawings. Since the mold and the anode for electrolyzing copper in the following description are same as those mentioned above, the same identification number or symbol shall be applied to each constituent element of such method and apparatus.

Figure 2:
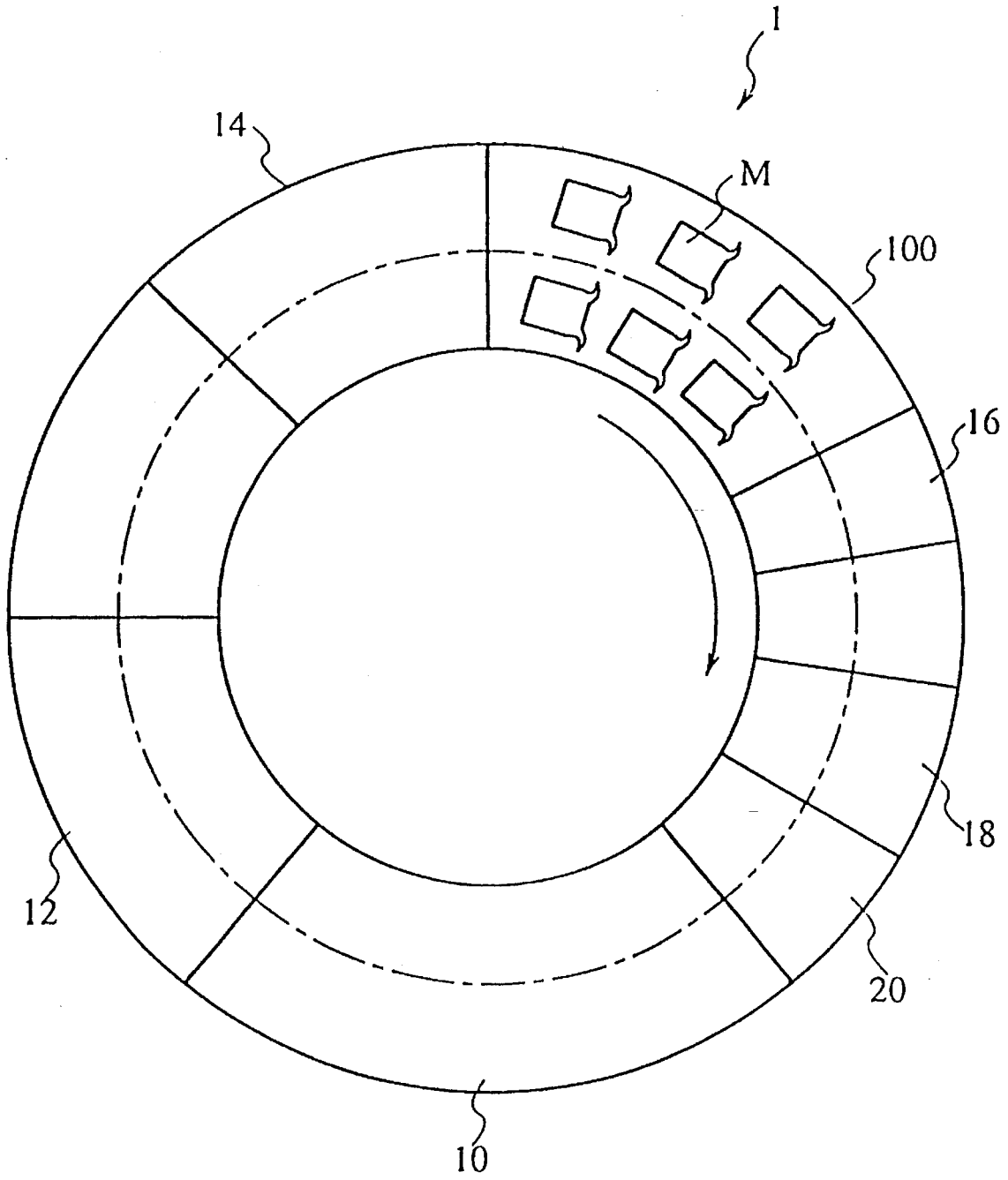
FIG. 2 is a general layout drawing showing an apparatus to pour molten copper into molds for casting copper anodes.

First, a casting apparatus for anodes for electrolyzing copper to which the present invention is applied shall be explained by referring to the general layout drawing shown in FIG. 2. As shown in the drawing, the casting apparatus 1 generally consists of a casting part 10, a first cooling part 12, a pattern-drawing part 14, a second cooling part 16, a milk hood part 18, a finning prevention agent application part 20, and a mold transfer part 100 for transferring a number of molds M to each one of the parts mentioned above while revolving in the direction shown by the arrow in a state having many molds placed thereon, all of which are arranged in a doughnut form. In this embodiment, the molds M are transferred in a state that 30 molds are arranged in two rows for one revolving circulation.

Figure 6:
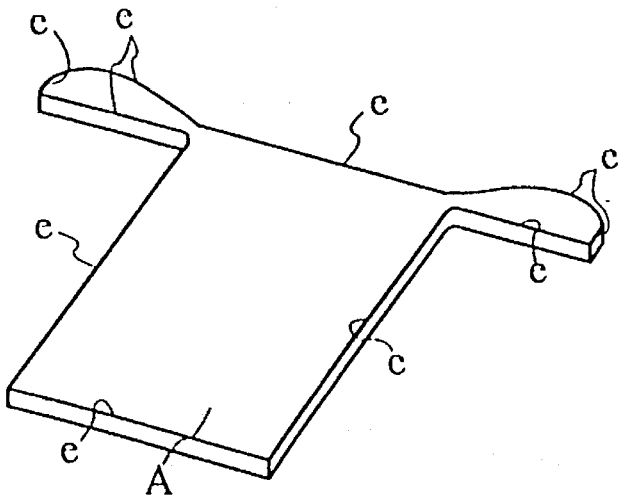
FIG.6 PRIOR ART
FIG. 6 is an oblique view to show a copper anode.
Figure 7:
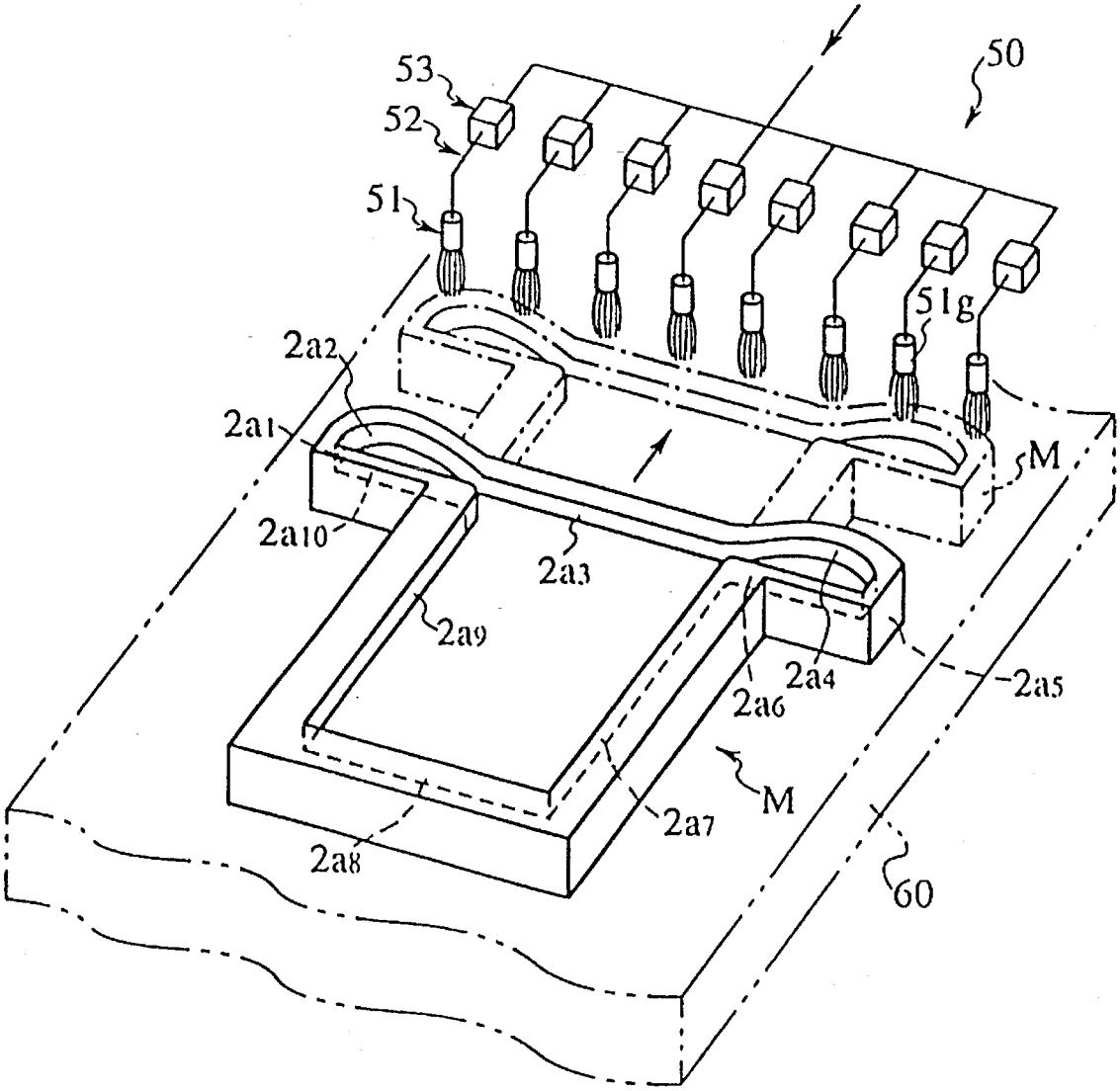
FIG.7 PRIOR ART
FIG. 7 is a schematic view to show a conventional finning preventive agent application apparatus.

At the casting part 10, molten copper of copper grade of about 99.3% at approximately 1,110°~1,120° C. coming out of a refining furnace which constitutes the last stage of the melt-refining process is poured into the molds M, as mentioned above, then the refined blister copper poured into the molds M is cooled at the first cooling part 12. The refined blister copper cooled at the first cooling part 12, that is, formed anodes A (FIG. 6), are taken out of the molds M by known means. Here in this embodiment, the anodes A are to be made into anodes for electrolyzing in a production of electrolytic copper (about 99.99 wt % Cu). Then, the molds M from which anodes A have been taken out and are empty are further cooled down to a temperature suited to a next process.

Figure 5:
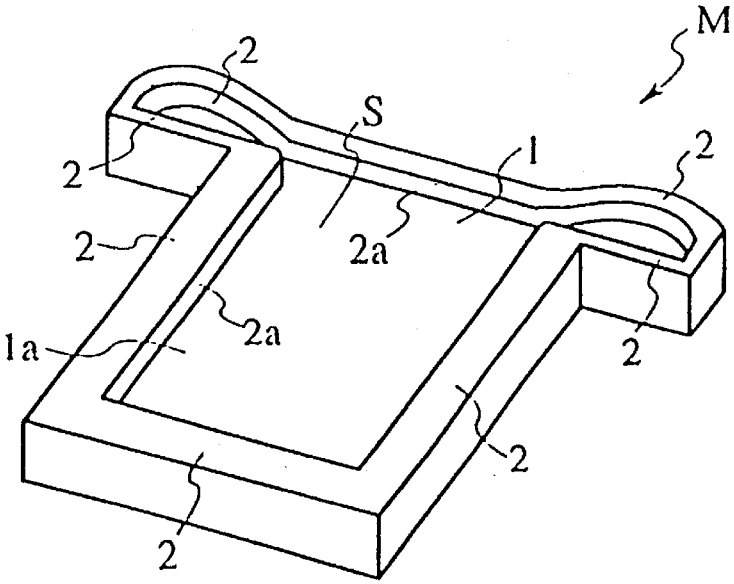
FIG.5 PRIOR ART
FIG. 5 is an oblique view to show a mold.

At the next milk hood part 18, parting compound is sprayed over a bottom planes S (FIG. 5) of the molds M, then finning preventive agent is applied onto inner circumferential planes of the molds M at the finning preventive agent application part 20 in a manner as will be explained in detail later, and then at the next casting part 10, refined blister copper is poured into the molds M which have had parting compound sprayed on their bottom planes and at the same time have had finning preventive agent applied onto their inner circumferential planes as mentioned above. These processes are performed in turn and anodes A will be thus produced.

Figure 3:
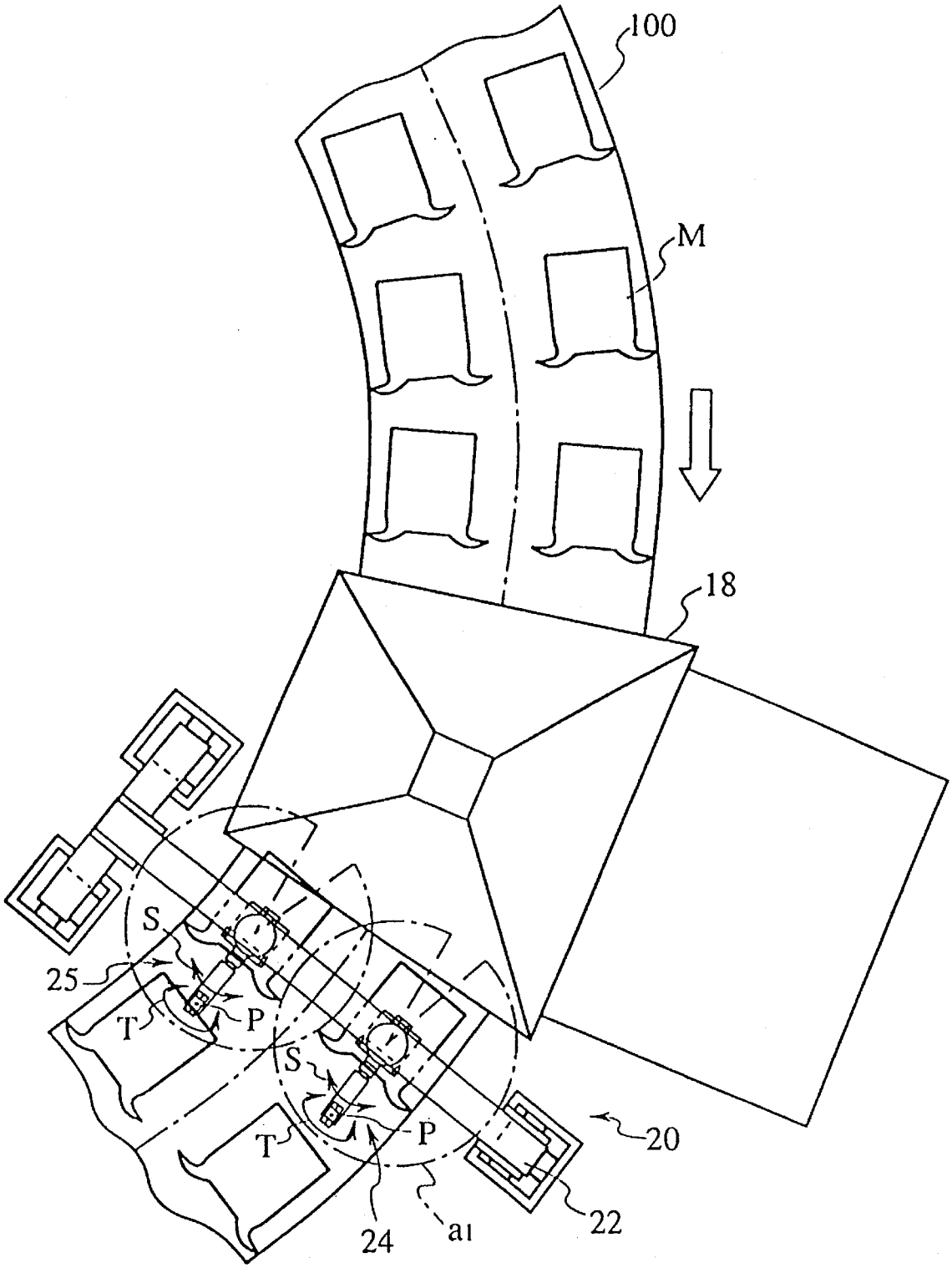
FIG. 3 is a plan to show a finning preventive agent application apparatus.
Figure 4:
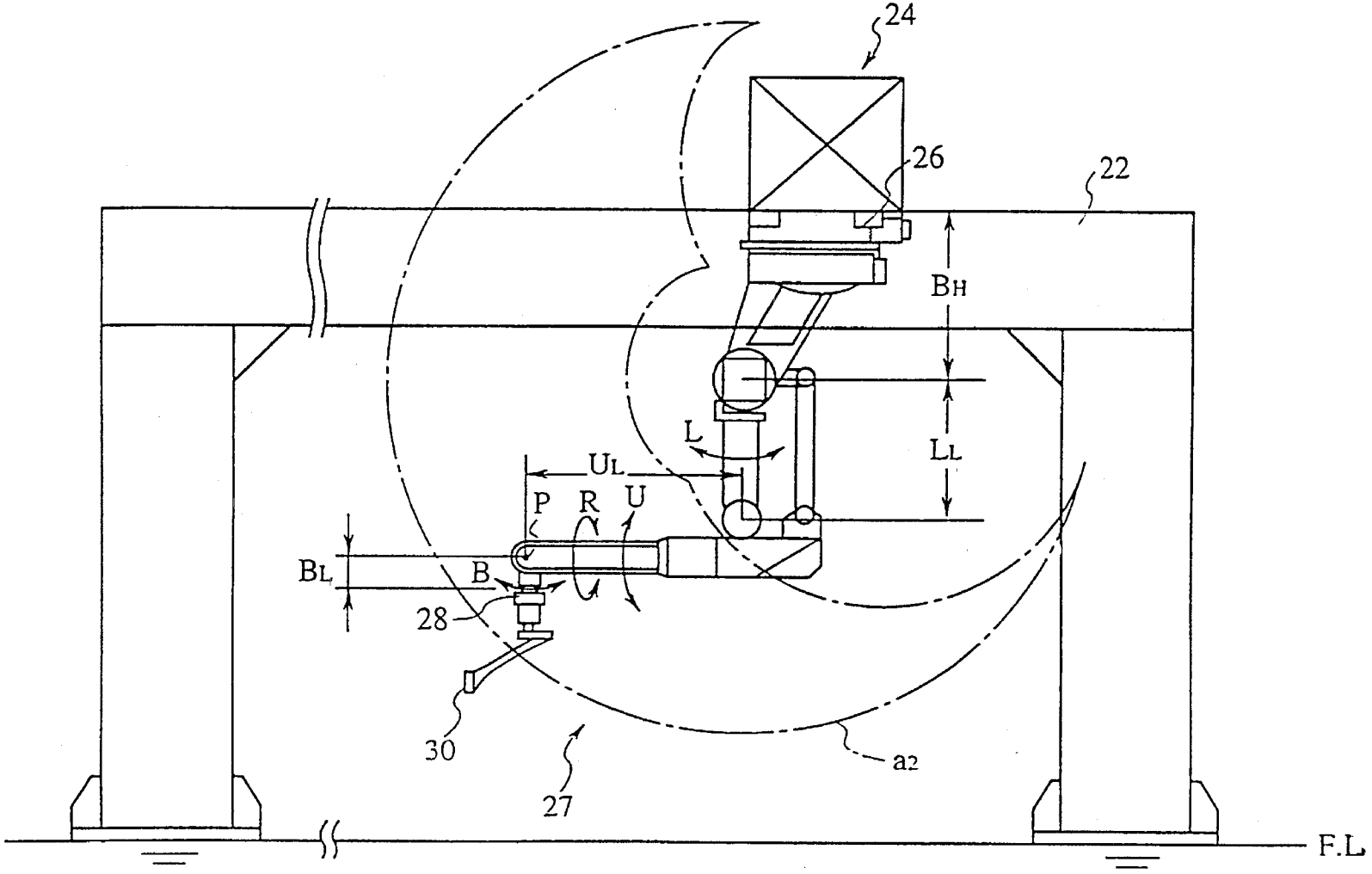
FIG. 4 is a side elevation to show a part of the finning preventive agent application apparatus shown in FIG. 3.

Now, the application method and apparatus of the finning preventive agent, which constitute the characterizing part of the invention, shall be explained. A gate shape member 22 is provided at the finning preventive agent application part 20 across an upper portion of the mold transfer means 100, and two industrial robots 24 and 25 for automatically coating the molds M with finning preventive agent are provided at the gate shaped member 22, as shown in FIGS. 3 and 4. These robots 24 and 25 are of so-called hanging type wherein their base portions 26 are fixed to the gate shaped member 22 and working parts 27 which correspond to arms of human body are positioned underneath the base portions.

The robot 24 used in this embodiment is preferably of a vertical multi-articulate type, and for example, Motoman-K6SJ (made by YASKAWA Electric Corporation) may be used. Such robots are of a vertical multi-articulate type having 6 degrees of freedom of motion, and are provided with the following maneuverability (the maximum operating ranges):

Rotation (S-axis)=340°;

Tilting of upper arm (U-axis)=270°;

Swing of wrist (B-axis)=270°;

Tilting of lower arm (L-axis)=240°

Rotation of wrist (R-axis)=360°;

Rotation of wrist (T-axis)=400°;

Length of L-axis LL=450 mm;

Length of B-axis BL=100 mm;

Length of U-axis U=680 mm;

Height of Base B.=550 mm.

With such capability, the maximum operating range of a point P which is located at the forward end of the robot will be the region $a_1$, $a_2$, shown by the dash and dotted lines of FIGS. 3 and 4. Also, the operations of the robots are made by instructions of the data input from a teaching box which is not shown in the drawing, and such data can be changed freely.

At a forward end of a wrist 28 of the robot 24, a brush 30 constituting the application member for carrying out the coating operation is provided. Such brush may be a brush with coating width of about 10~70 mm×60~100 mm, commercially available.

Next, the method of coating of the molds M with finning preventive agent, which is silicon oil in this embodiment, by the above mentioned robot 24 will be explained in detail by referring to FIG. 1.

The molds M are transferred by the mold transfer means 100 at a speed of 14~15 minutes per one revolving circulation and the coating of the inner circumferential wall planes of the molds is done by the robots in harmony with such speed. This coating operation is done in three divided coating per one mold. That is, after applying the silicon oil to the brush 30 by dipping at a silicon oil housing part which is suitably positioned, the inner wall plane $2a_7$ of the mold is coated by this brush at the first circulation (①). In the second circulation, coating is made from the inner wall planes $2a_9$ to the inner wall plane $2a_8$ (②), then the inner wall planes $2a_5$, $2a_4$, $2a_6$, the inner wall plane $2a_3$, and the inner wall planes $2a_2$, $2a_1$, $2a_{10}$ are coated in the third circulation (③). Such coating operation is done by the two robots 24, 25 on all of the molds M.

In addition, when silicone oil is fed to the brush 30, a feeding pump can be used to directly apply silicone oil to the base of the brush 30 from the silicone oil housing part. Such a way can prevent silicone oil from being dropped from the brush 30 as the brush moves to the molds M, which is apt to occur in applying silicone oil to the brush 30 by dipping the brush in the silicone oil housing part, and also can accomplish uniform supply of silicone oil to the brush 30 to thereby coat each inner wall plane uniformly.

It is preferable to apply about 4~10 cc of the finning preventive agent, that is, silicon oil, to one mold when the agent is applied by the above mentioned method. That will be, for example, 30~40 cc per 1 $m^2$ for the inner wall planes $2a_1$~$2a_{10}$, shown in FIG. 1. If the quantity is smaller than the 4 cc/mold, the intended object can not be achieved, while the quantity exceeding the 10 cc/mold merely means an excess.

Also, depending on the control method of the robots, the silicon oil coating work may be completed with one circulation or with two circulations, or depending on the requirements, the coating may be done in a greater number of circulations than what is mentioned above.

The finning preventive agent can be applied to inner circumferential planes of molds in a very reliable and efficient manner by utilizing industrial robots having brushes provided at their wrist portions, as has been explained above. Therefore, while splashes of the finning preventive agent over other areas than the intended portions could not be prevented when a conventional spray nozzles were used, an amount of the finning preventive agent used could be reduced to a very small level. Results of experimentations revealed that an amount of the finning preventive agent could be reduced by about 40~60% compared to that in the case when conventional spray nozzles were used.

As being apparent from what has been explained, the coating method with finning preventive agent according to this invention, having industrial robots of a vertical multi-articulate type with application members positioned above the above mentioned mold transfer means, and having at least portions of the inner planes of the molds coated with finning preventive agent at every circulation of the molds as the molds are transferred by the mold transfer means, can automatically coat the inner planes of the molds with the finning preventive agent in a reliable and efficient manner. The productivity and the quality of the copper anodes can be remarkably enhanced by this method and at the same time an amount of the finning preventive agent can be reduced, which provide substantial economic advantages.

Also, the coating apparatus with finning preventive agent according to this invention can automatically apply the finning preventive agent over the inner planes of the molds, as the apparatus has industrial robots of vertical multi-articulate type provided above the mold transfer means and has the application members provided at wrist portions of the industrial robots, thus the same effects as mentioned above can be secured.

The present invention may be embodied in other specific forms without departing from the spirit or essential attributes thereof and, accordingly, reference should be made to the appended claims, rather than the foregoing specification, as indicating the scope of the invention.

What is claimed is:

1. An apparatus for coating molds used for casting anodes of electrolyzing copper comprising:

(a) a plurality of molds for receiving molten copper, each mold having a recess which is defined by an upper plane of a base having a shape of an anode to be cast and inner circumferential planes of edges surrounding an outer circumference of the base and protruding upwards from the upper plane of the base;

(b) mold transfer means movable in a circulating manner to transfer said molds to stations including:

a casting station at which molten copper is poured into the molds;

a first cooling station at which the poured molten copper is cooled;

a pattern-drawing station at which the cooled copper is taken out of the molds to form anodes;

a second cooling station at which the molds from which the anodes have been taken out are cooled to a temperature suited to a next stage;

a milk hood station at which a parting compound is sprayed over the upper planes of the bases; and a finning preventive agent application station at which a finning preventive agent is applied onto the inner circumferential planes of the edges by a coating apparatus;

(c) said coating apparatus comprising:

a gate-shaped member positioned at the finning preventive agent application station across an upper portion of the mold transfer means;

at least one industrial robot for coating the inner circumferential planes with the finning preventive agent; and said robot having vertical multi-articulation with six degrees of freedom of motion, having a base portion fixed to the gate-shaped member, and having working parts positioned underneath the base portion; and (d) said robot having a wrist as one of the working parts and brush means for applying the finning preventive agent onto the inner circumferential planes being provided at an end of the wrist.

2. The apparatus according to claim 1, wherein the molds are arranged in two rows on the mold transfer means, and two said robots are fixed to the gate-shaped member.

3. The apparatus according to claim 1, wherein the stations are arranged around a doughnut-shaped loop.

4. The apparatus according to claim 1, wherein the wrist of the robot extends in a direction of circulation of the mold transfer means, and the brush means are provided on the end of the wrist which points in the direction of circulation.

* * * * *